United States Patent [19]

Kolkind

[11] Patent Number: 4,934,708

[45] Date of Patent: Jun. 19, 1990

[54] FAMILY QUIZ BOARD GAME

[76] Inventor: Gerald L. Kolkind, c/o Heirloom Custom Greetings, Inc., 3534 Coachman Rd., Eagan, Minn. 55122-1212

[21] Appl. No.: 387,838

[22] Filed: Aug. 1, 1989

Related U.S. Application Data

[63] Continuation-in-part of Ser. No. 197,024, May 20, 1988.

[51] Int. Cl.[5] ..... A63F 3/00; A63F 9/18

[52] U.S. Cl. ..... 273/240; 273/243; 273/248

[58] Field of Search ..... 273/240, 243, 249, 248

[56] References Cited

U.S. PATENT DOCUMENTS

| | | | |
|---|---|---|---|
| 3,179,414 | 4/1965 | Mertz et al. | 273/240 |
| 4,029,320 | 6/1977 | Hausman | 273/249 |
| 4,684,136 | 8/1987 | Turner | 273/240 |

FOREIGN PATENT DOCUMENTS

| | | | |
|---|---|---|---|
| 1469067 | 3/1977 | United Kingdom | 273/243 |
| 2187393 | 9/1987 | United Kingdom | 273/249 |

OTHER PUBLICATIONS

Trivial Pursuit, Master Game-Rules of Play, Selchow & Righter Co., 1981.

*Primary Examiner*—Benjamin Layno
*Attorney, Agent, or Firm*—Richard C. Litman

[57] ABSTRACT

A quiz game including questions about family members that a garnered through personal research and knowledge. The game includes a gameboard, tokens representing individual players, game cards resembling miniature buses having passenger spaces to be filled in by the player, and a pair of throw dice to determine the moves of the tokens on a sequential path on the gameboard. When a token lands on any of a number of certain spaces in the sequential path a question card is drawn and right or wrong answer given. A passenger space is to be filled in on the game card for each correct answer. A full bus and a right answer in a "Parking Lot" space wins the game.

7 Claims, 1 Drawing Sheet

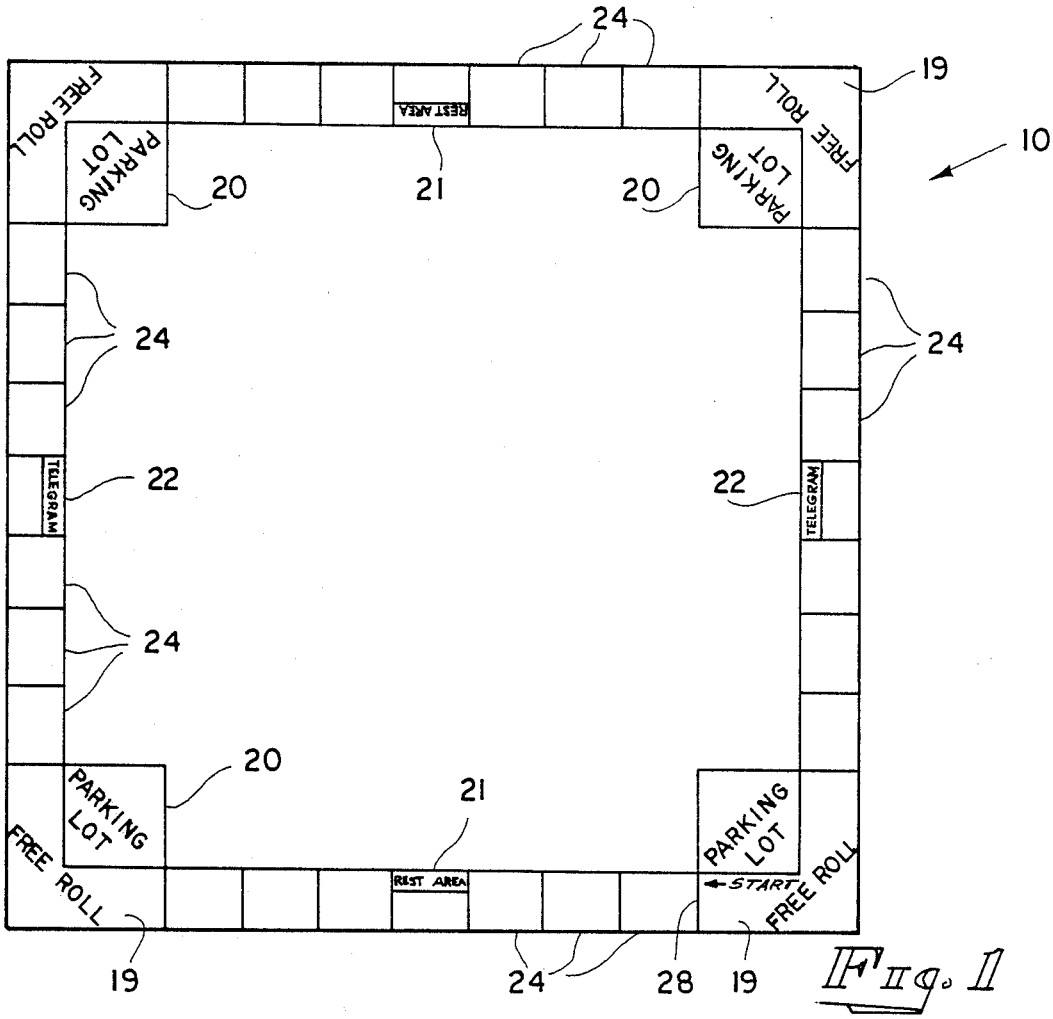
Fig. 1
Fig. 2
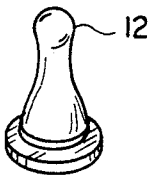
Fig. 3
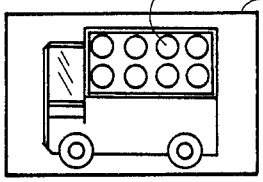
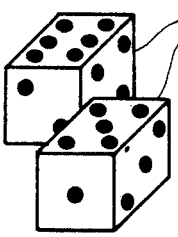
Fig. 6
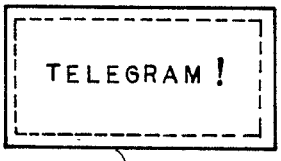
Fig. 5A
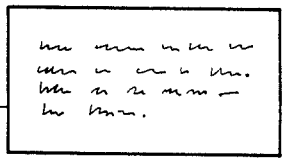
Fig. 5B
Fig. 4A
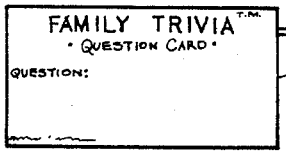
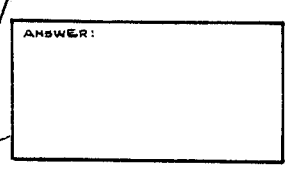
Fig. 4B

FAMILY QUIZ BOARD GAME

CROSS REFERENCE TO RELATED APPLICATIONS

This application is a continuation-in-part application of the previous application Ser. No. 07/197,024 filed May 20, 1988.

BACKGROUND OF THE INVENTION

1. Field of the Invention

This invention is drawn to a game where participants are questioned about facts that have been researched for a particular family. The game includes a gameboard with different types of spaces making up a segmental path about the periphery of the square gameboard. Selecting a starting point, the players throw dice and count off spaces in accordance to the number shown on the dice. Certain spaces when landed upon require that a question to a previously researched fact be asked from a card of the player who threw the dice and moved his token to this certain space. Other spaces required other actions. Everytime a correct answer is given, a passenger space is filled in on the game card which resembles a bus.

When the maximum capacity of eight passengers is achieved, by filling in all the spaces on the game card, the token seeks out if the roll of the dice is right for the "Parking Lot" space. When a token of a person with a full game card lands on such a preferred space the player represented by the token is asked a question from the cards. A correct answer wins the game.

2. Description of the Prior Art

U.S. Pat. No. 4,375,288 issued to J. G. Guertin is drawn to a game where tokens with the faces of various people are mounted on a tree representing a family tree. When cards are matched with relationship and a proper method of researching vital statistics of that relationship, a token is acquired. The first player to acquire a given number of tokens wins the game.

U.S. Pat. No. 4.230,321 issued to M. E. Smith is drawn to a game where cards are dealt and arranged according to relationship, some cards have more points than others. The relationship may be similar to the games "solitaire" or "gin rummy".

U.S. Pat. No. 1,638,433 to A. B. Copeland is drawn to a game including a deck of question cards with points designated o each card for correct answers. There is provision for one player challenging another to answer a particular question. High score wins.

U.S. Pat. No. 1,327,019 to C. Britton is drawn to a card game with questions and answers as one o: its alternative type of games. History Oral Arithmetic, Spelling Bee, Question and Electing of Presidents box make up the questions-and-answers-subjects.

U.S. Pat. No. Des. 270,741 to C. Haney et al is drawn to a game board of circular design and segmental path.

None of the above prior art patents include the step of personalizing the questions around facts pertaining to a single family as does the present invention.

SUMMARY OF THE INVENTION

It is an object of this invention to incite curiosity about one's family and members of the family.

It is a further object to motivate research into one's family background.

It is further object to provide a game board with a segmental path.

It is a further object to provide a token to represent each of several players.

It is a further object to provide each player with a game card having the representation of a bus upon it, the bus having spaces to be filled in by the player.

It is a further object to make cards with questions-and-answers about one's family members and their backgrounds.

It is a further object to make a game out of answering these questions with an element of chance.

It is a further object to make the element of chance governed by dice and a gameboard.

It is a further object to make a square gameboard With a mental path of several questions asked at particular segmental spaces along the path.

It is a further object to make the spaces at the periphery of a square gameboard.

BRIEF DESCRIPTION OF THE DRAWINGS

FIG. 1 is drawn to a game board for the execution of the game.

FIG. 2 is drawn to a token which resembles a Chess pawn.

FIG. 3 is drawn to the game card in the form of a bus with the spaces to be filled in by the player.

FIGS. 4*a* and 4*b* represent two sides of a question-and-answer-card.

FIGS. 5*a* and 5*b* represent two sides of a "Telegram" card.

FIG. 6 is drawn to throw dice by which each token is moved along the segmental path.

DETAILED DESCRIPTION OF THE PREFERRED EMBODIMENT

There are eight game pieces, tokens 12, of different colors to represent the identity of as many as eight players. Each token 12 resembles a Chess pawn as in FIG. 2. Game cards 11 have the representation of a bus on them, having spaces 16, that represent passengers, to be filled in by the player with an easily removable writing medium such as a grease crayon. The card 14 can be glossy coated so as to allow such markings to be easily wiped away with a wet cloth or the like. The objective of the game is to be the first player to fill his or her game card 14 with 8 passengers by filling up spaces 16 and to park his or her token 12 in a preferred position called a parking lot 20. This position in on a game board 10 as in FIG. 1 to be described below.

Many blank question cards 18 comprise the main aspect of the game. It is the task of at least one person to do research into facts about the members of a family and to make up questions about these facts. The questions can be put on one side of all of the cards that will be used in the game and the corresponding answer to each question can be put on the opposite side of each card.

A game board 10 as previously mentioned introduces along with dice 23 an element of chance to the game. The gameboard is designed as in FIG. 1 and includes a segmental path next to the perimeter of a square, the configuration of the board. The segmental paths is made up of spaces symmetrically arranged about the periphery of the board. The corner spaces are divided into two areas. One area is devoted to a "free roll" 19 and the other area, set-off interiorly of the "free roll" area, devotes a "parking lot" 20. Midway of each corner space is a "telegram" space 21 or "rest area" on each of the four sides of the square board and its segmental path. Between each corner space and "telegram" space 21 or "rest area" space 22 are three spaces which may for example be colored tan. There is a total of six tan spaces 24 on a side of the square a grand total of twenty four for the whole board 10.

The tokens 12 travel clockwise around the board with one of the corner spaces designated as the starting point 26. The extent of a move along the periphery of the board is determined by the roll of the dice 23 of the player represented by a particular token; the number rolled on the pair of dice 23 is counted off sequentially on the spaces.

If a token lands on a tan space 24 a question card 18 is drawn and the player represented by the token 12 is asked the question. A correct answer earns the player the right to fill in a space 16 representing a passenger for the bus on the game card 14. If a token 12 moves to a "telegram" space 22 the player draws a "telegram" card 26 supplied by the manufacturer with special instructions to the player, for example "Your nephew shows up at your door to spend the weekend. Take one rider, and roll the dice again."

When a player lands on a space labeled Free Roll 19 the player rolls the dice 23 again, and moves his token 12 appropriately.

When a player lands on a space labeled "Rest Area" his turn is immediately over, and the dice 23 are passed to the next player.

When a player lands on a tan space already occupied by another player, the player landing on the space may at his option force the player already on the space, to answer a "Make Or Break" question. This question, is a regular family question from the cards 18 having these questions but, if the player who is forced to answer the question does not answer correctly, he must remove one of his riders by erasing a space 16 on the game card 14. A correct answer results in the player, who forced the question, relinquishing a passenger 16. If the question is not answered correctly the forcing player's turn is continued and he rolls the dice 23 again. If a player lands on a space already occupied by two or more players the player landing on the space may choose one player to have answer a "Make Or Break" questions. Both players participating in a "Make Or Break" question must have at least one rider each, before a "Make Or Break" question may be asked.

When a player has accumulated the eight passengers or filled spaces 16 required to fill his or her game card 14 the player will no longer land on the "Free Roll" 19 spaces, but instead land on spaces marked "Parking Lot" 20. When a player has landed on a "Parking lot" 20 space he will be asked to answer a question. If the player answers the question correctly, he has parked his token 12 and is the winner, and the game is over. Special provisions are made for an incorrect answer, or if the wrong answer is given on a "Make And Break" questions before getting a Parking Lot 20, or a Telegram 26 instructs removal of a passenger or addition of a passenger when the maximum has already been attained. All of the details of the special provisions are included in an instruction booklet included with the game.

It is to be understood that the present invention is not limited to the sole embodiment described above, but encompasses any and all embodiments within the scope of the following claims.

I claim:

1. A method of playing a game involving family members wherein the players' knowledge of trivia relating to fellow family members is tested, comprising:

providing initially blank question and answer cards;

providing Telegram cards having previously printed player instructions thereon;

entering questions concerning specific facts, relationships, events or the like pertaining to specific relatives of the players at hand on a first side of said cards;

entering on a second side of said cards the respective answers to the questions previously entered on said first side of said cards;

providing a game board having a plurality of sequentially disposed spaces thereon;

providing each player with a token;

providing each player with a game card having a plurality of passenger spaces that can be filled in by the player with a marking device;

providing random number generating means operable to signify the number of said spaces to which each player advances their token;

providing means on selected ones of said game board spaces indicating that a player whose token lands thereon is to draw one said question and answer card and if that player correctly answers that question permitting them to fill in one of said plurality of passenger spaces on said game card;

providing means on selected other ones of said game board spaces indicating that a player whose token lands thereon is to forego drawing any question and answer card and must pass their turn on to the next following player;

providing means on selected still other ones of said game board spaces indicating that a player whose token lands thereon is to draw one said Telegram card and carry out the instructions thereon;

providing among said game board spaces a plurality of Parking Lot spaces, whereby players sequentially determine the number of said spaces to advance their token by operating said random number generating means, then fill in one said passenger spaces on their respective game card upon correctly answering each question upon drawing said question and answer cards, with the winner of the game being determined by the first player who completely fills their game card passenger spaces and who thereafter first lands on one said Parking Lot space and draws one said question and answer card and correctly answers the question thereon.

2. The method of playing a game according to claim 1 including, providing means on selected further ones of said game board spaces indicating that a player whose token lands thereon is to turn over their turn to the next player in sequence without drawing one said question and answer card.

3. The method of playing a game according to claim 1 wherein, said random number generating means comprises a pair of dice.

4. The method of playing a game according to claim 1 wherein, the number of said selected ones of said game board spaces substantially outnumber the total of all other ones of said game board spaces.

5. The method of playing a game according to claim 1 Wherein, said game board is polygonal, and said Parking Lot spaces are disposed adjacent the corners of said polygonal game board.

6. The method of playing a game according to claim 1 wherein.

said game card has the representation of a bus printed upon it, said passenger spaces being within said representation.

7. The method of playing a game according to claim 1 wherein, said marking device is a wax pencil.

* * * * *